United States Patent [19]

Beckerman et al.

[11] 4,283,659

[45] Aug. 11, 1981

[54] DISPLAY SYSTEM UTILIZING INCANDESCENT LAMP MULTIPLEXING

[75] Inventors: Howard L. Beckerman, Middletown; William S. N. Trimmer, Belle Mead, both of N.J.

[73] Assignee: The Singer Company, Stamford, Conn.

[21] Appl. No.: 137,927

[22] Filed: Apr. 7, 1980

[51] Int. Cl.[3] ..... H05B 39/00

[52] U.S. Cl. ..... 315/161; 315/169.1; 315/313; 315/317; 340/166 R; 340/780

[58] Field of Search ..... 315/161, 169.1, 312, 315/313, 317; 340/166 R, 760, 780, 811, 812

[56] References Cited

U.S. PATENT DOCUMENTS

| | | | |
|---|---|---|---|
| 3,573,788 | 4/1971 | Molnar et al. | 340/753 |
| 3,585,629 | 6/1971 | Baynard, Jr. | 340/331 X |
| 3,623,066 | 11/1971 | Norris | 340/811 X |
| 3,684,918 | 8/1972 | Schmersal | 340/718 |
| 3,689,889 | 9/1972 | Feucht et al. | 340/166 R |
| 3,728,714 | 4/1973 | Kolesar et al. | 340/780 X |
| 3,733,435 | 5/1973 | Chodil et al. | 315/169.1 X |
| 3,821,721 | 6/1974 | Hughes | 340/767 |
| 3,909,822 | 9/1975 | Lee et al. | 340/331 X |
| 4,063,234 | 12/1977 | Arn et al. | 340/780 |
| 4,134,132 | 1/1979 | Magos et al. | 340/780 X |

*Primary Examiner*—Eugene R. La Roche

*Attorney, Agent, or Firm*—David L. Davis; Robert E. Smith; Edward L. Bell

[57] ABSTRACT

A display system utilizing incandescent lamps arranged at the intersection points of a matrix array of row and column conductors includes a plurality of load resistors connecting the row conductors to a first voltage source and a plurality of load resistors connecting the column conductors to a second voltage source. To energize a selected lamp, the row conductor connected to that lamp is connected to the second voltage source and the column connected to that lamp is connected to the first voltage source.

4 Claims, 6 Drawing Figures

Fig.3
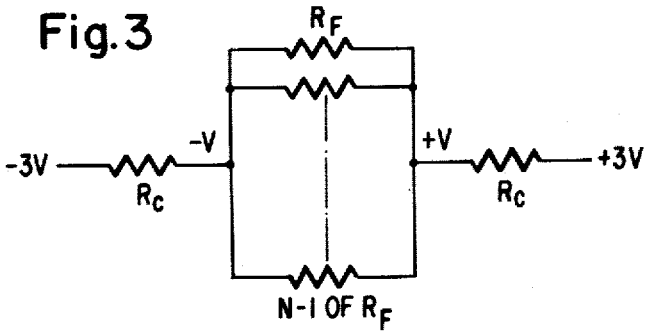
Fig.4
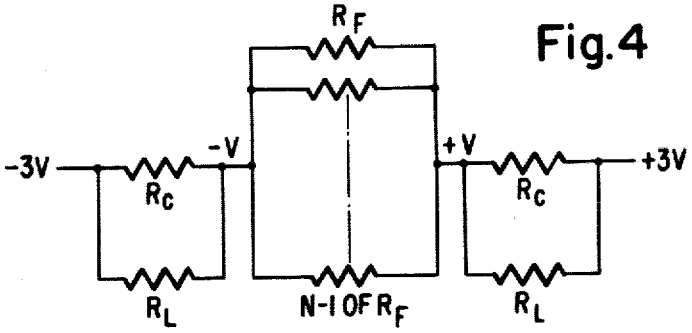
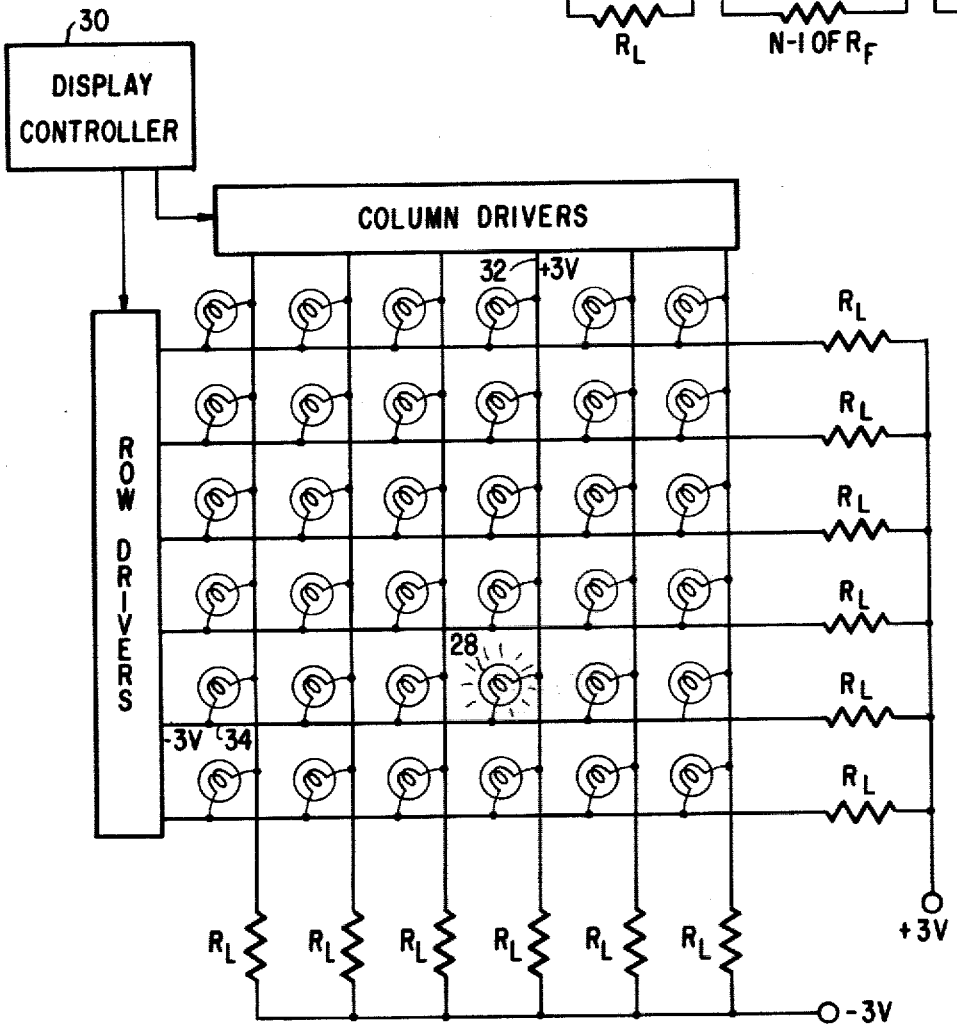
Fig.5

DISPLAY SYSTEM UTILIZING INCANDESCENT LAMP MULTIPLEXING

DESCRIPTION

Background of the Invention

This invention relates to display systems wherein a functional indicium corresponding to a selected function is lit up to indicate such selection and, more particularly, to such a display system utilizing incandescent lamps wherein all the functional indicia are at least dimly lit.

There are many applications where a selection and/or display arrangement includes a panel having functional indicia printed thereon, which indicia are selectively lit up to visually indicate the functional status of the overall system to which the selection/display arrangement is appended. When designing such an arrangement, a primary consideration is the cost of the arrangement. One of the main contributors to the cost of such an arrangement is the total number of power drivers required for the light emitting elements. A common technique for reducing driver cost is to multiplex the light emitting elements in a matrix array of row and column conductors, with a single light emitting element connected at each intersection of a row conductor and a column conductor. In such an arrangement, the number of drivers can be reduced to at most the sum of the number of column conductors and row conductors.

The above-described type of arrangement works well with unidirectional current carrying light emitting elements, such as light emitting diodes, which eliminate sneak paths through the matrix array. However, it is sometimes desirable to use incandescent filament lamps which do not possess such a current rectification characteristic. When using such elements, some other means of preventing sneak current paths must be found.

It is therefore an object of this invention to provide a display system utilizing incandescent filament lamps.

It is another object of this invention to provide such an arrangement which minimizes the number of power drivers required.

Incandescent lamps possess the characteristic that their brightness is related to the voltage applied thereacross. There are many applications where it is desirable to dimly light a display and only brightly light a selected lamp. For example, in a sewing machine, it would be desirable to dimly light all the pattern graphic indicia and brightly light the selected pattern indicium.

It is therefore a further object of this invention to provide an arrangement of the type described wherein all the lamps are at least dimly lit and a selected lamp may be brightly lit.

SUMMARY OF THE INVENTION

The foregoing and additional objects are attained in accordance with the principles of this invention by providing a display system comprising a first plurality of column conductors, a second plurality of row conductors and a plurality of voltage sensitive light emitting elements arranged at respective intersection points of a matrix array of the row and column conductors. There are further provided a first voltage source at a first voltage level and a second voltage source at a second voltage level differing from the first voltage level by a first voltage difference. A first plurality of load resistors are each connected between a respective one of the first plurality of column conductors and the first voltage source and a second plurality of load resistors are each connected between a respective one of the second plurality of row conductors and the second voltage source. There is also provided means for connecting the first voltage source to one of the row conductors and the second voltage source to one of the column conductors. Accordingly, the one light emitting element at the intersection point of the one column conductor and the one row conductor has the first voltage difference applied thereacross to relatively brightly light the one element and the remaining elements all have a second voltage difference less than the first voltage difference applied thereacross to relatively dimly light the remaining elements.

BRIEF DESCRIPTION OF THE DRAWINGS

The foregoing will be more readily apparent upon reading the following description in conjunction with the drawings wherein:

FIG. 3 shows an equivalent resistor network for the matrix array of FIG. 2;

FIG. 4 illustrates an improvement to the equivalent resistor network of FIG. 3;

FIG. 5 illustrates a square matrix array display system in accordance with the principles of this invention utilizing the improved resistor network of FIG. 4.

DETAILED DESCRIPTION

Figure 1:
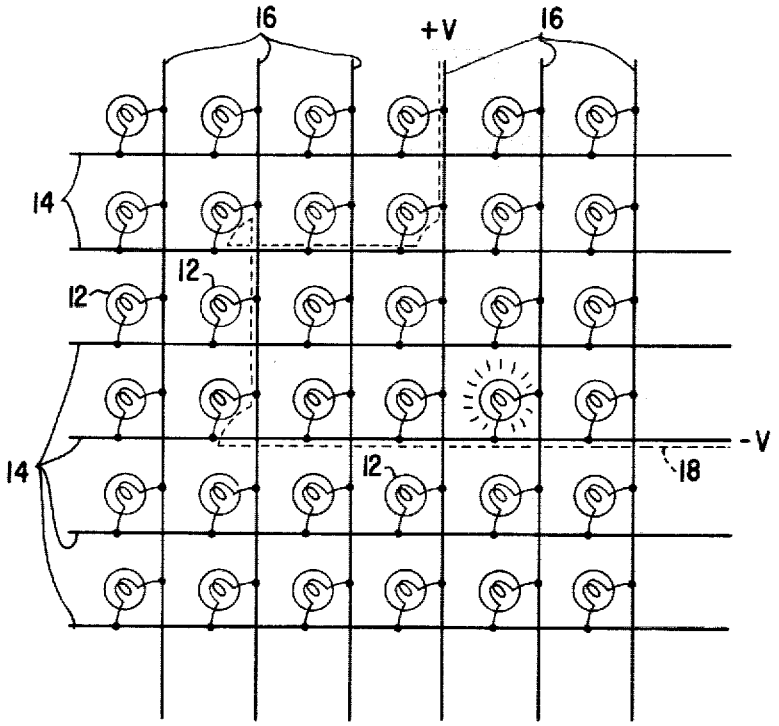
FIG. 1 is a schematic diagram of a matrix display arrangement of incandescent filament lamps utilizing a single driver for each column and row conductor and illustrating different types of current paths.

Referring now to the drawings, wherein like elements in different figures thereof have the same reference character applied thereto, FIG. 1 shows a matrix array of incandescent filament light emitting elements 12 arranged at the intersection points of a plurality of row conductors 14 and column conductors 16. In such an array, it is common to energize a light emitting element at a selected cross point by applying a first voltage level to the column conductor to which the element is connected and a second voltage level, differing from the first voltage level, to the row conductor to which the selected element is connected. Light emitting diodes are well suited to such an arrangement because their current rectification characteristic prevents current sneak paths. However, these sneak paths are a problem when utilizing bidirectional current carrying elements such as incandescent lamps. Thus, examining FIG. 1, the bright lamp is at the intersection of the column to which the voltage level $+V$ is applied and the row to which the voltage level $-V$ is applied. However, there are many other paths that the current can follow. One of these sneak paths is shown by the broken line 18.

When the arrangement shown in FIG. 1 is examined, it is found that there are three different levels of lamp brightness. The brightest lamp is at the intersection of the row and column to which the voltages are applied. Next in brightness are the lamps that touch either that row or column. These lamps form a cross, and will be referred to as the cross lamps. The remaining lamps are dimmer and will be referred to as the field lamps.

Figure 2:
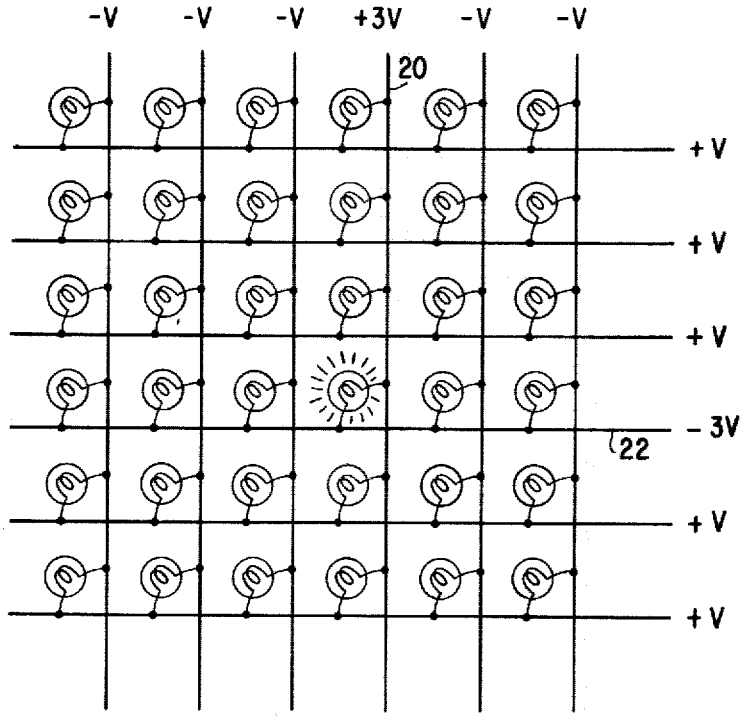
FIG. 2 schematically depicts a matrix display system utilizing incandescent filament lamps wherein sneak paths have been eliminated.

FIG. 2 shows an arrangement for eliminating the troublesome "cross" effect so that all the lamps except the one at the selected intersection are at the same brightness. In this arrangement, all of the column conductors are at a voltage level of $-V$ except for the selected column which is at a level of $+3$ V. Similarly, all of the row conductors are at a voltage level of $+V$ except for the selected row which is at a voltage level of $-3$ V. Examination of this arrangement reveals that there is a voltage difference of 2 V across each of the lamps with the exception of the lamp at the intersection of the selected row and column which has a voltage difference of 6 V thereacross. Accordingly, the desired result of having a uniform background of dim lamps with one bright lamp has been achieved. However, this particular multiplexing arrangement is expensive. It takes at least three power supplies to provide the required voltages. (The $-3$ V can be considered ground, so that one would need $+2$ V, $+4$ V and $+6$ V supplies.) Also, two drivers are needed per line. In the columns for example, one needs a driver to pull the line to $-V$ and a driver to pull the line to $+3$ V. Since this is a $6\times6$ array, there are 12 lines and thus 24 drivers are needed. To drive 36 lamps, it is almost as easy to drive each lamp directly and what would be desirable is an arrangement that required only one driver per line.

Such an arrangement can be achieved in accordance with the principles of this invention by adding a simple resistor network. This arrangement requires only a single driver per line, can be run off a single power supply, and is easy to implement using commercially available AC power. In order to analyze the resistor network, the network of lamps has to be analyzed. This is not a straightforward matter since it is not a linear resistor network due to the fact that the resistance of the lamps changes with applied voltage. However, if the number of columns equals the number of rows, the network is symmetrical and the network solution may be fairly easily derived. This solution follows.

Let the number of rows equal the number of columns equal N. The direct path from the column 20 to the row 22 includes a single lamp which can be represented by a single resistor of resistance $R_B$. All the other paths involve cross and field lamps. In each of these paths, current from the column 20 to the row 22 must pass through one of the $(N-1)$ cross lamps that touch the column 20, $N-1$ of the $(N-1)^2$ field lamps that do not touch either the column 20 or the row 22, and then through one of the $(N-1)$ cross lamps that touch the row 22. Denoting the resistance of the cross lamps as $R_C$ and the resistance of the field lamps as $R_F$, the aforedescribed path is shown in FIG. 3. In order to have all of the cross and field lamps with the same brightness, the same current must flow through all of the lamps. An examination of FIG. 3 shows that more current will flow through each of the cross lamps than through each of the field lamps. The current through the lamps can be equalized by putting a load resistor of value $R_L$ across each of the cross lamps, as shown in FIG. 4. The value of the load resistor $R_L$ can now be calculated. Each of the parallel networks should have the same resistance so that there is the same voltage drop across each network. Setting these resistances equal and solving for $R_L$ gives the following equations:

$$\frac{1}{R_C} + \frac{1}{R_L} = \frac{(N-1)}{R_F}$$

$$R_L = \frac{R_F R_C}{R_C(N-1) - R_F}$$

But since the lamps now have equal voltage across them, they have equal resistance, $R_F = R_C$ and $$R_L = \frac{R_F}{(N-2)}$$

Thus, the load resistor $R_L$ acts like $(N-2)$ lamps across each field lamp.

FIG. 5 shows the network of lamps with the addition of the load resistors $R_L$. The side of the load resistors away from the lamp matrix is permanently connected to either $+3$ V or $-3$ V. Illustratively, the load resistors connected to the row conductors are connected to $+3$ V and the load resistors connected to the column conductors are connected to $-3$ V so that to select a lamp, illustratively the lamp 28, the display controller 30 signals the column driver connected to the column 32 to apply $+3$ V to the column 32 and signals the row driver connected to the row 34 to apply $-3$ V to the row 34. The other rows and columns are not connected and their voltages are controlled by the resistor network.

Figure 6:
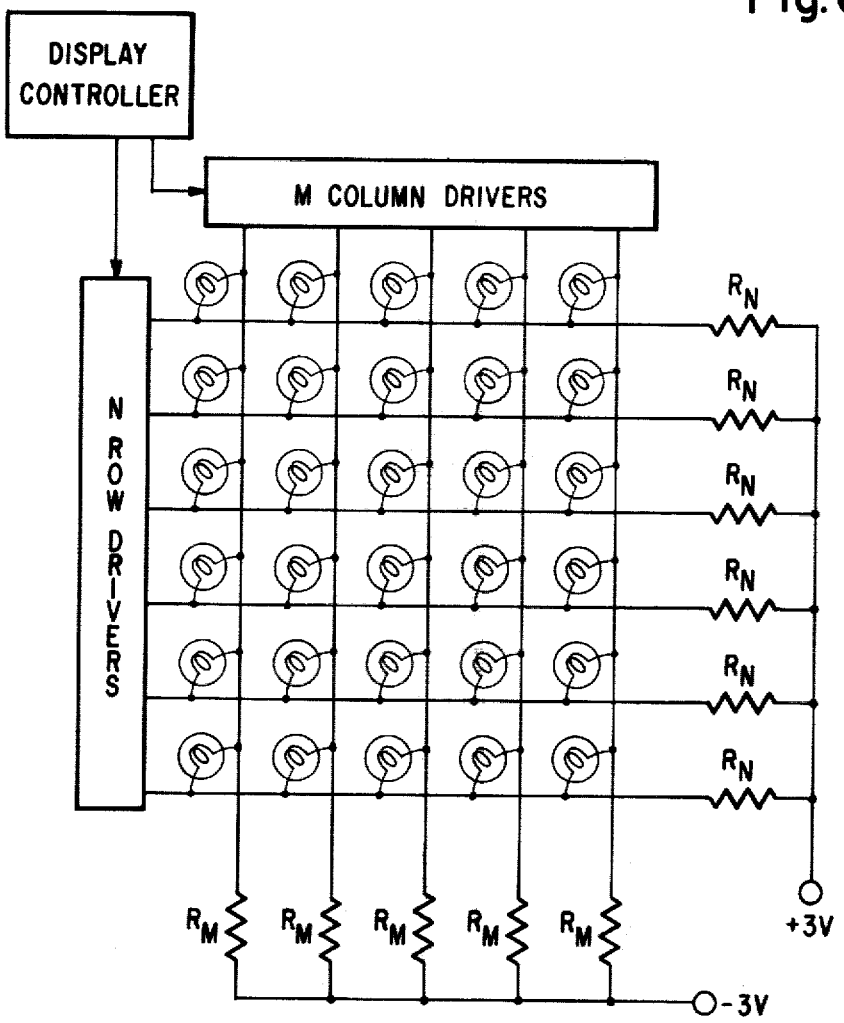
FIG. 6 illustrates a non-square matrix array display system in accordance with the principles of this invention utilizing the improved resistor network of FIG. 4.

The aforedescribed arrangement has assumed that the number of column conductors equals the number of row conductors. FIG. 6 shows a non-square N row by M column arrangement of lamps. The row load resistors $R_N$ and the column load resistors $R_M$ should have the values $$R_N = \frac{R_F}{(M-2)} \text{ and}$$

$$R_M = \frac{R_F}{(N-2)}$$

If, in a particular application, the number of lamps does not fit conveniently into a M column by N row array, a convenient size larger array should be used with either lamps or resistors at the unneeded "dummy" crosspoints.

The aforedescribed system has all the desired properties described above. Only a single driver is used per line, i.e., the line is either connected or left floating. Only a single power supply is required. (Although FIG. 5 has been described with respect to a power supply at $-3$ V and a power supply of $+3$ V, this network works equally well utilizing ground and $+6$ V.) Alternatively, triacs can be used to drive the lines from commercially available 60 hertz AC power. The only additional components needed are resistors.

Experimental results confirm the aforedescribed analysis. Experimentally, a $4\times4$ matrix of 16 lamps was constructed. With 2 volts applied, each lamp drew 37 milliamperes. With 6 volts applied, each lamp drew 67 milliamperes. Hence, the resistance of the bright lamps was 90 ohms and the resistance of each of the field and cross lamps was 54 ohms. Since the number of rows and columns was 4, the load resistor value was calculated to be 27 ohms. The optical contrast of the bright to dim lamps was 130.

Accordingly, there has been disclosed an improved display system utilizing incandescent lamps. It is understood that the above-described embodiment is merely illustrative of the application of the principles of this invention. Numerous other embodiments may be devised by those skilled in the art without departing from the spirit and scope of the invention, as defined by the appended claims.

We claim:

1. A display system comprising:

a first plurality of column conductors;

a second plurality of row conductors;

a plurality of voltage sensitive light emitting elements arranged at respective intersection points of a matrix array of said row and column conductors;

a first voltage source at a first voltage level;

a second voltage source at a second voltage level differing from said first voltage level by a first voltage difference;

a first plurality of load resistors each connected between a respective one of said first plurality of column conductors and said first voltage source;

a second plurality of load resistors each connected between a respective one of said second plurality of row conductors and said second voltage source; and means for connecting said first voltage source to one of said row conductors and said second voltage source to one of said column conductors;

whereby the one light emitting element at the intersection point of said one column conductor and said one row conductor has said first voltage difference applied thereacross to relatively brightly light said one element and the remaining elements all have a second voltage difference less than said first voltage difference applied thereacross to relatively dimly light said remaining elements.

2. The system according to claim 1 wherein said light emitting elements are incandescent lamps.

3. The system according to claim 1 wherein the number of column conductors equals the number of row conductors and the resistance value of each of said first and second pluralities of load resistors equals $$\frac{R}{(N-2)}$$

where R equals the resistance value of a light emitting element with said second voltage difference applied thereacross and N equals the number of column or row conductors.

4. The system according to claim 1 wherein there are M column conductors and N row conductors and the resistance value of each of said first plurality of load resistors equals $$\frac{R}{(N-2)}$$

and the resistance value of each of said second plurality of load resistors equals $$\frac{R}{(M-2)},$$

where R equals the resistance value of a light emitting element with said second voltage difference applied thereacross.

* * * * *